US009149683B2

(12) United States Patent
Watterson et al.

(10) Patent No.: US 9,149,683 B2
(45) Date of Patent: Oct. 6, 2015

(54) EXERCISE DEVICE CONTROL RING

(71) Applicant: ICON HEALTH & FITNESS, INC., Logan, UT (US)

(72) Inventors: Scott R. Watterson, Logan, UT (US); Darren C. Ashby, Richmond, UT (US)

(73) Assignee: ICON Health & Fitness, Inc., Logan, UT (US)

( * ) Notice: Subject to any disclaimer, the term of this patent is extended or adjusted under 35 U.S.C. 154(b) by 44 days.

(21) Appl. No.: 14/083,343

(22) Filed: Nov. 18, 2013

(65) Prior Publication Data

US 2014/0073482 A1 Mar. 13, 2014

Related U.S. Application Data

(62) Division of application No. 13/444,346, filed on Apr. 11, 2012, now abandoned.

(60) Provisional application No. 61/583,158, filed on Jan. 4, 2012.

(51) Int. Cl.

| | |
|---|---|
| ***A63B 24/00*** | (2006.01) |
| ***A63B 15/02*** | (2006.01) |
| ***A63B 71/00*** | (2006.01) |
| ***A63B 21/005*** | (2006.01) |
| ***A63B 22/00*** | (2006.01) |
| ***G08C 19/00*** | (2006.01) |
| ***A63B 22/02*** | (2006.01) |
| *A63B 71/06* | (2006.01) |

(52) U.S. Cl.

CPC ..... *A63B 24/0087* (2013.01); *A63B 22/0242* (2013.01); *G08C 19/00* (2013.01); *A63B 22/00* (2013.01); *A63B 2024/0093* (2013.01); *A63B 2071/065* (2013.01); *A63B 2225/09* (2013.01); *A63B 2225/50* (2013.01)

(58) Field of Classification Search

USPC ..... 482/1, 4

See application file for complete search history.

(56) References Cited

U.S. PATENT DOCUMENTS

| | | | | |
|---|---|---|---|---|
| 4,643,418 | A | 2/1987 | Bart, et al. | |
| 4,708,337 | A | 11/1987 | Shyu, et al. | |
| 5,314,391 | A | 5/1994 | Potash et al. | |
| 5,368,532 | A | 11/1994 | Farnet | |
| 5,383,827 | A | 1/1995 | Stern | |
| 5,613,216 | A * | 3/1997 | Galler | 455/66.1 |
| 5,910,070 | A * | 6/1999 | Henry et al. | 482/4 |
| 6,135,924 | A | 10/2000 | Gibbs et al. | |
| 6,328,677 | B1 | 12/2001 | Drapeau | |
| 6,572,511 | B1 * | 6/2003 | Volpe | 482/4 |

(Continued)

OTHER PUBLICATIONS

Office Action issued in U.S. Appl. No. 13/444,346 on Aug. 15, 2013.

*Primary Examiner* — Loan H Thanh
*Assistant Examiner* — Shila Jalalzadeh Abyane
(74) *Attorney, Agent, or Firm* — Holland & Hart LLP

(57) ABSTRACT

A control ring that usable in adjusting one or more operating parameters of an exercise device includes a body, user input mechanisms, and a transmitter. The control ring is wearable on a finger of an exerciser. The body of the control ring has an interior surface and an exterior surface. The user input mechanisms are associated with the body and may be selectively activated by the exerciser. Upon activation of the user input mechanisms, the transmitter communicates a control command to an exercise device in order to adjust the operating parameters of the exercise device.

18 Claims, 7 Drawing Sheets

(56) References Cited

U.S. PATENT DOCUMENTS

| | | | | |
|---|---|---|---|---|
| 6,740,009 | B1 * | 5/2004 | Hall | 482/54 |
| 2004/0051392 | A1 * | 3/2004 | Badarneh | 307/112 |
| 2005/0215397 | A1 * | 9/2005 | Watterson et al. | 482/54 |
| 2006/0189440 | A1 * | 8/2006 | Gravagne | 482/8 |
| 2007/0004562 | A1 * | 1/2007 | Pan et al. | 482/54 |
| 2007/0049462 | A1 * | 3/2007 | Asukai et al. | 482/8 |
| 2007/0049470 | A1 | 3/2007 | Pyles et al. | |
| 2009/0286653 | A1 * | 11/2009 | Wiber | 482/4 |
| 2010/0022354 | A1 | 1/2010 | Fisher | |
| 2010/0093492 | A1 * | 4/2010 | Watterson et al. | 482/4 |
| 2011/0082011 | A1 | 4/2011 | Ellis | |
| 2011/0086707 | A1 * | 4/2011 | Loveland | 463/36 |
| 2011/0118089 | A1 | 5/2011 | Ellis | |
| 2011/0221672 | A1 * | 9/2011 | Osterhout et al. | 345/156 |
| 2011/0275489 | A1 | 11/2011 | Apau | |
| 2012/0015784 | A1 | 1/2012 | Reed | |
| 2012/0218184 | A1 * | 8/2012 | Wissmar | 345/158 |

* cited by examiner

EXERCISE DEVICE CONTROL RING

CROSS-REFERENCE TO RELATED APPLICATIONS

This application is a divisional application of U.S. patent application Ser. No. 13/444,346, filed on Nov. 4, 2012, entitled EXERCISE DEVICE CONTROL RING, which application claims priority to and the benefit of U.S. Provisional Patent Application No. 61/583,158, filed on Jan. 4, 2012, and entitled EXERCISE DEVICE CONTROL RING, which applications are incorporated herein by reference in their entireties.

TECHNICAL FIELD

This disclosure relates generally to systems, methods, and devices for exercise. More particularly, the disclosure relates to a ring worn by an exerciser and which the exerciser can use to control the operating parameters of an exercise device.

BACKGROUND

Exercise devices are being used at an ever increasing rate. Individuals use exercise devices to improve their health and fitness level. Many exercise devices are used when an individual's schedule or inclement weather prohibits the individual from exercising outdoors. Additionally, some exercise devices, such as treadmills, are used to train for competitions. For instance, distance runners often use treadmills to train for upcoming races. Such training allows the individual to conveniently monitor various aspects of their performance (e.g., pace, cadence, speed, distance, time, etc.) during their training session since many treadmills track and display such information. Additionally, treadmills with adjustably inclining treadbases can also simulate the terrain the user will experience during the upcoming race. As a result, individuals do not have to train at the actual location of an upcoming race to be familiar with the race course.

While treadmills can be useful in exercising and training for a race, some individuals find it difficult to manipulate the treadmill controls, and thereby adjust the operating parameters of the treadmill, while exercising on the treadmill. The difficulty in manipulating the treadmill controls often increases as individuals increase their speed from walking to jogging to running. Not only can it become more difficult to manipulate the treadmill controls as an individual's speed increases, but reaching to manipulate the treadmill controls can also have a negative impact on the individual's exercise performance. For instance, it may be difficult for an individual to maintain his/her pace and/or form when reaching to manipulate the treadmill controls.

Various exercise devices have been developed that allow for the adjustment of a treadmill's operating parameters without requiring an individual to manipulate controls on the treadmill console. For instance, U.S. Pat. No. 5,910,070 discloses a hand-held controller for remotely controlling an exercise device such as a treadmill. The hand-held controller includes buttons and a transceiver that communicates with the treadmill to adjust the operating parameters of the treadmill. Similarly, U.S. Patent Publication No. 2007/0004562 discloses a remote control for wirelessly communicating with a treadmill to control the treadmill. Other exercise devices that allow for the adjustment of operating parameters without manipulation of console controls are disclosed in U.S. Pat. No. 4,643,418, U.S. Pat. No. 4,708,337, U.S. Pat. No. 5,314,391, U.S. Pat. No. 5,368,532, U.S. Pat. No. 6,135,924, and U.S. Pat. No. 6,740,009.

SUMMARY OF THE INVENTION

In one example embodiment of the disclosure, a control ring is usable in adjusting one or more operating parameters of an exercise device. The control ring includes a body that has an interior surface and an exterior surface and which is wearable on a finger of an exerciser. The control ring also includes one or more user input mechanisms associated with the body. The one or more user input mechanisms may be selectively activated. Further, the control ring includes a transmitter associated with the one or more user input mechanisms. The transmitter communicates a control command to the exercise device upon activation of the one or more user input mechanisms to adjust the one or more operating parameters of the exercise device.

In another aspect that may be combined with any of the aspects herein, a control ring includes one or more straps connected to a body, wherein the one or more straps selectively secure the body on a finger of an exerciser.

In another aspect that may be combined with any of the aspects herein, the one or more straps include a first strap connected to a first end of the body and a second strap connected to a second end of the body.

In another aspect that may be combined with any of the aspects herein, the first strap and the second strap may be selectively connected to one another to selectively secure the body on a finger of an exerciser.

In another aspect that may be combined with any of the aspects herein, the first strap and the second strap may be selectively connected to one another with at least one of a hook and loop fastener, a clip, and a buckle.

In another aspect that may be combined with any of the aspects herein, the one or more straps comprise a strap connected between a first end and a second end of the body, such that the strap and the body cooperate to define an aperture through the control ring.

In another aspect that may be combined with any of the aspects herein, the strap is formed of a stretchable material.

In another aspect that may be combined with any of the aspects herein, the body is generally shaped as a ring and comprises an aperture for receiving the finger of the exerciser at least partially therethrough, the aperture having a diameter that generally corresponds to a diameter of the finger of the exerciser.

In another aspect that may be combined with any of the aspects herein, the interior surface of the control ring is generally arcuately shaped to generally correspond to the shape of an exerciser's finger.

In another aspect that may be combined with any of the aspects herein, the one or more user input mechanisms are disposed on the exterior surface of the body.

In another aspect that may be combined with any of the aspects herein, the one or more user input mechanisms comprise a speed increase button and a speed decrease button.

In another aspect that may be combined with any of the aspects herein, upon activation of the speed Increase button, the transmitter communicates a control command to the exercise device that causes the exercise device to increase the speed of a movable element of the exercise device.

In another aspect that may be combined with any of the aspects herein, upon activation of the speed decrease button, the transmitter communicates a control command to the exercise device that causes the exercise device to decrease the speed of a movable element of the exercise device.

In another aspect that may be combined with any of the aspects herein, the transmitter communicates with the exercise device via a wireless connection.

In another aspect that may be combined with any of the aspects herein, the control ring may be selectively paired with only one exercise device at any given time.

In another aspect that may be combined with any of the aspects herein, a control ring transmitter communicates with an exercise device only when the control ring is within a predetermined range of the exercise device.

In another aspect that may be combined with any of the aspects herein, the predetermined range includes a first zone and a second zone.

In another aspect that may be combined with any of the aspects herein, a control ring transmitter communicates control commands to an exercise device upon activation of one or more user input mechanisms when the control ring is within the first zone.

In another aspect that may be combined with any of the aspects herein, a control ring transmitter communicates only an emergency stop control command to an exercise device when the control ring is within the second zone.

In another aspect that may be combined with any of the aspects herein, a control ring includes a processor associated with one or more user input mechanisms and a transmitter.

In another aspect that may be combined with any of the aspects herein, a control ring processor generates control command upon activation of one or more user input mechanisms.

In another aspect that may be combined with any of the aspects herein, a size of a control ring body is adjustable to accommodate fingers of different sizes.

In another aspect that may be combined with any of the aspects herein, one or more user input mechanisms of a control ring include an emergency stop button, activation of which causes a control ring transmitter to communicate a control command to an exercise device that causes the exercise device to stop the movement of a movable element of the exercise device.

In another aspect that may be combined with any of the aspects herein, an exercise system includes an exercise device and a control ring.

In another aspect that may be combined with any of the aspects herein, an exercise device includes a movable element that is movable during the performance of exercise, the movable element having one or more adjustable operating parameters.

In another aspect that may be combined with any of the aspects herein, an exercise device includes a receiver that receives control commands related to one or more adjustable operating parameters of a movable element.

In another aspect that may be combined with any of the aspects herein, an exercise device includes an actuator that causes one or more adjustable operating parameters to be adjusted in response to control commands received by a receiver.

In another aspect that may be combined with any of the aspects herein, a control ring includes one or more selectively activatable user input mechanisms.

In another aspect that may be combined with any of the aspects herein, a control ring includes a transmitter associated with one or more user input mechanisms, wherein the transmitter communicates control commands to an exercise device upon activation of the one or more user input mechanisms to cause one or more operating parameters of a movable element to be adjusted.

In another aspect that may be combined with any of the aspects herein, a transmitter of a control ring is a wireless transmitter.

In another aspect that may be combined with any of the aspects herein, one or more adjustable operating parameters of an exercise device include a speed of the movable element.

In another aspect that may be combined with any of the aspects herein, an exercise device and a control ring may be selectively paired such that the exercise device is responsive to control commands from only a control ring with which it is paired.

In another aspect that may be combined with any of the aspects herein, a method for adjusting one or more operating parameters of an exercise device includes running an exercise program on an exercise device, wherein the exercise program controls the one or more operating parameters of the exercise device, and wherein the exercise program is initiated via a user input mechanism on the exercise device.

In another aspect that may be combined with any of the aspects herein, a method for adjusting one or more operating parameters of an exercise device includes receiving user input at a control ring worn by an exerciser on an exercise device, wherein the user input relates to a desired adjustment to be made to one or more operating parameters of the exercise device.

In another aspect that may be combined with any of the aspects herein, a method for adjusting one or more operating parameters of an exercise device includes transmitting a control command from a control ring to an exercise device, wherein the control command is representative of a user input received at the control ring.

In another aspect that may be combined with any of the aspects herein, a method for adjusting one or more operating parameters of an exercise device includes adjusting one or more operating parameters of an exercise device in response to a control command.

DETAILED DESCRIPTION

Figure 1:
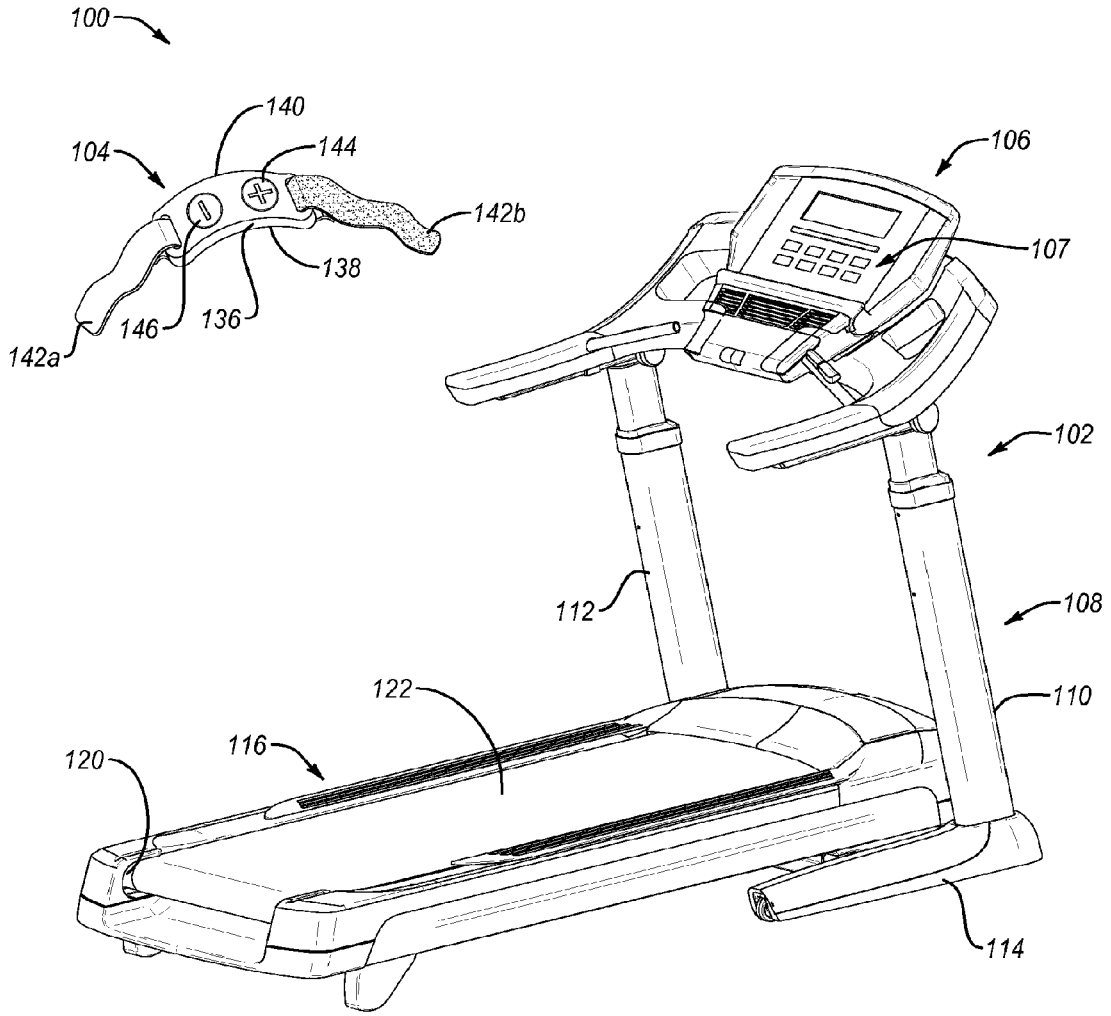
FIG. 1 illustrates an exercise system according to one example embodiment of the present invention.
Figure 2:
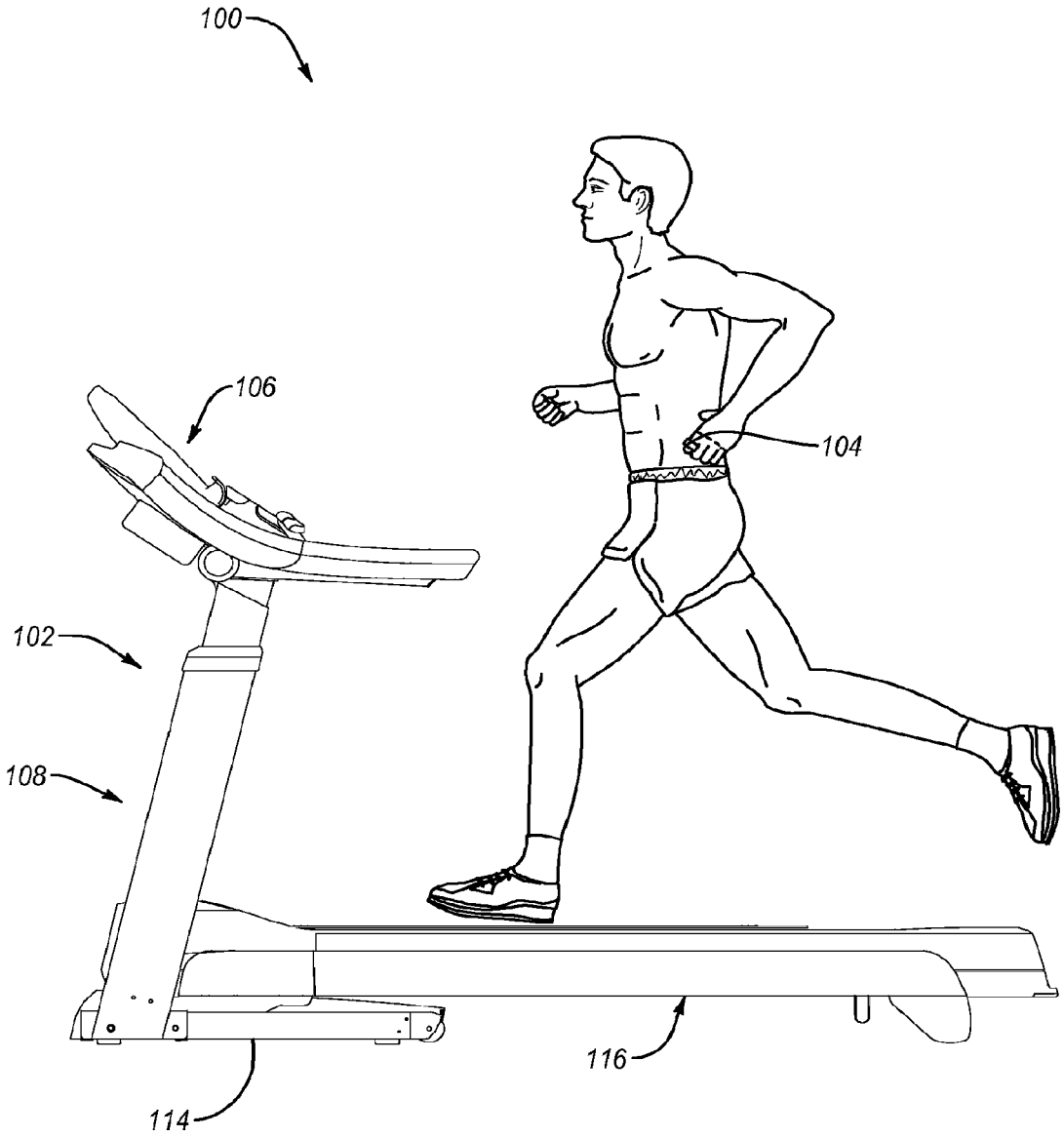
FIG. 2 is a side view of the exercise system of FIG. 1 with an exerciser exercising therewith.

The present disclosure is directed to systems, methods, and devices for exercise. Depicted in FIGS. 1 and 2 is a representation of one illustrative exercise system 100, which may incorporate the novel features of the present invention, including various novel devices, functionalities, hardware and software modules, and the like. As shown, exercise system 100 includes an exercise device 102 and a control ring 104. In FIG. 2, an exerciser is shown exercising on exercise device 102 while wearing control ring 104 on a finger.

In the illustrated embodiment, exercise device 102 is depicted as a treadmill and includes a console or control panel 106 having user input mechanisms 107 that may be used to control various aspects of exercise device 102. Control panel 106 is illustrated as being supported on a generally upright support structure 108. Upright support structure 108, in this illustrated embodiment, includes two side members 110, 112 connected to a base frame 114. Side members 110, 112 and base frame 114 may have various configurations and may be fabricated from various materials so long as they are capable of supporting control panel 106.

A treadbase 116 is connected to support structure 108 and typically includes front and rear pulleys 118, 120 with a continuous belt 122 extending between and around front and rear pulleys 118, 120, respectively. Treadbase 116, front and rear pulleys 118, 120, and continuous belt 122 may be considered, individually or collectively, as movable elements that are movable during the performance of an exercise. A deck 124 typically supports the upper run of belt 122 and an exercising individual positioned upon belt 122.

As is common with electric treadmills, at least one of front pulley 118 and rear pulley 120 may be mechanically connected to an actuator, such as an electric belt drive motor 126. In the illustrated embodiment, belt drive motor 126 turns front or rear pulley 118, 120 in order to rotate belt 122. Belt drive motor 126 is electrically connected to a controller 128 that controls the operation of belt drive motor 126, and thus the speed of belt 122, in response to various inputs. The speed of belt 122 is one example of an adjustable operating parameter of exercise device 100.

Controller 128 can be incorporated within treadbase 116, control panel 106, or another portion of exercise device 100. Controller 128 may take the form of a computer, a processor, a microprocessor, a micro controller, state machine or other similar device that includes circuitry for controlling the operation of one or more features on exercise device 100, including the operating parameter(s) of the movable element(s). As will be discussed in greater detail below, controller 128 may also perform other functions, such as receiving and implementing control commands received from control ring 104.

In addition to the ability to control and vary the speed of belt 122, exercise device 100 may also permit variations in the degree of incline of treadbase 116 relative to base frame 114, the floor, or other support surface upon which exercise device 100 rests. For instance, treadbase 116 can be oriented in a neutral position, an inclined position, or a declined position. In the neutral position, treadbase 116 may be generally parallel to the support surface, as shown in FIG. 2. In the inclined position, the front portion of treadbase 116 (e.g., the end of treadbase 116 adjacent to support structure 114) is vertically higher than the rear portion of treadbase 116 to enable an exerciser to simulate walking or running up a hill. Similarly, in a declined position the front portion of treadbase 116 is vertically lower than the rear portion of treadbase 116 to enable an exerciser to simulate walking or running down a hill.

The inclining and declining capabilities of treadbase 116 provide exercise device 100 with additional operating parameters that may be adjusted to vary the intensity of exercises performed on exercise device 100. The inclination and declination of treadbase 116 can be accomplished through the use of one or more actuators, such as an inclination mechanism. One example inclination mechanism includes an extension mechanism 130 connected between support structure 108 and treadbase 116. Extension mechanism 130 can include an incline motor 132 that may be controllable by controller 128 to cause an extension member 134 of extension mechanism 130 to extend or retract in order to move treadbase 116 between the declines, neutral, and inclined positions.

As shown in FIG. 1, control ring 104 includes a body 136 that has an interior surface 138 and an exterior surface 140. Interior surface 138, and optionally all of body 136, is generally arcuate in shape. Interior surface 138 may be sized and shaped such that control ring 104 can be worn on a finger of an exerciser, as shown in FIG. 2. That is, interior surface 138 may be curved or otherwise shaped to generally correspond to the shape of an exerciser's finger.

Control ring 104 includes straps 142*a*, 142*b* that may be used to selectively secure body 136 on an exerciser's finger. A fastener or fastening means may be used to secure straps 142*a*, 142*b* together. For instance, in the illustrated embodiment, straps 142*a*, 142*b* include a hook and loop fastener such as VELCRO®. More specifically, strap 142*a* includes a loop fabric on one side and strap 142*b* includes a hook fabric on one side, such that straps 142*a*, 142*b* can be secured together to hold body 136 on an exerciser's finger. In other embodiments, straps 142*a*, 142*b* may be secured together using clips, buckles, and the like. Straps 142*a*, 142*b* and the fasteners/fastening means may cooperate to make the size of control ring 104 adjustable so that control ring 104 can be worn on fingers of different sizes.

Control ring 104 also includes user input mechanisms 144, 146. In the illustrated embodiment, user input mechanisms 144, 146 are disposed on or extend from exterior surface 140 of body 136. As discussed in greater detail below, user input mechanisms 144, 146 may be selectively activated by an exerciser in order to adjust the operating parameters of exercise device 102. For instance, user input mechanism 144 may be a speed increase button and user input mechanism 146 may be a speed decrease button. Upon activation of user input mechanism 144, control ring 104 may communicate a control command to exercise device 102 that results in an increase in the speed of one or more of the movable elements of exercise device 102. Similarly, upon activation of user input mechanism 146, control ring 104 may communicate a control command to exercise device 102 that results in a decrease in the speed of one or more of the movable elements of exercise device 102.

Figure 3:
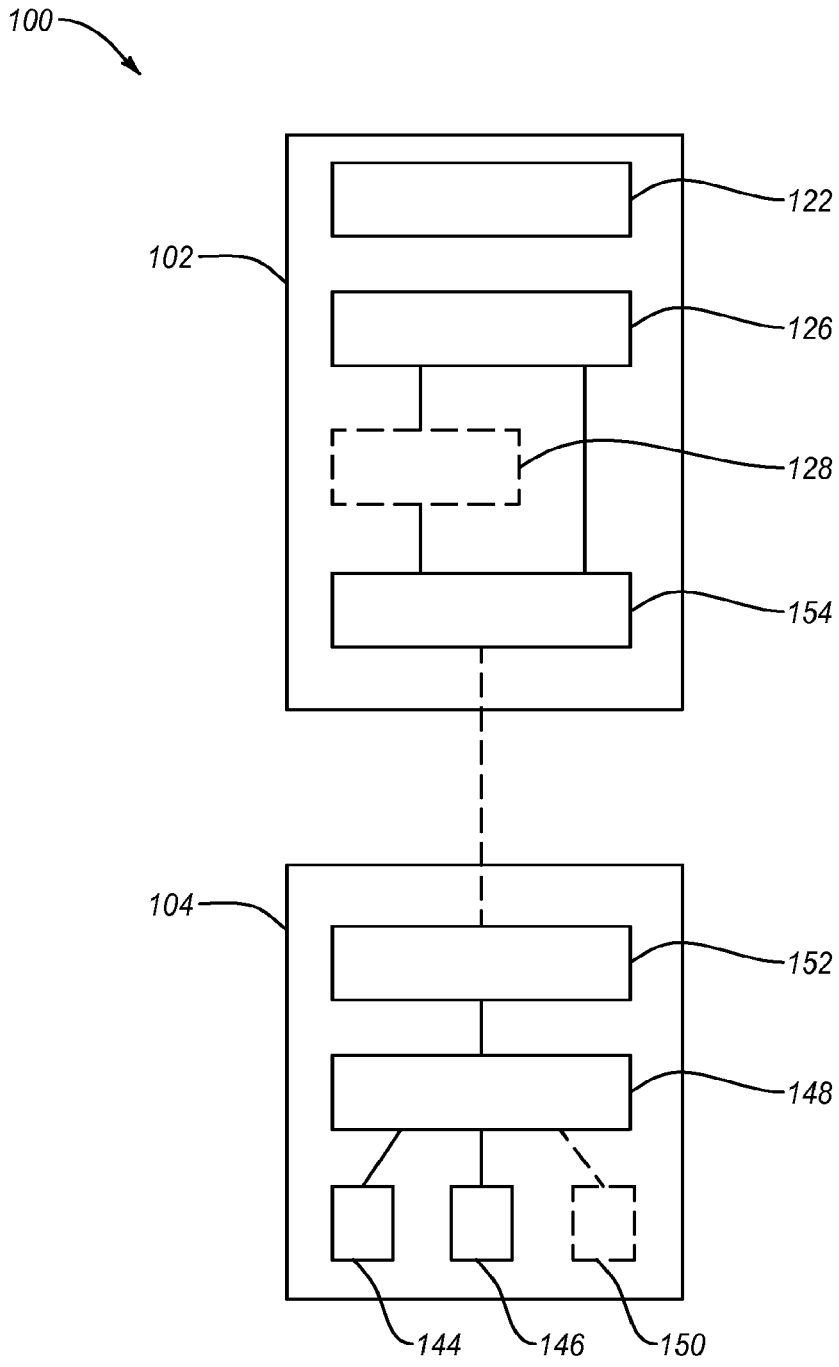
FIG. 3 is schematic diagram of the exercise system of FIG. 1.

With continued attention to FIGS. 1 and 2, attention is now directed to FIG. 3, which illustrates a block diagram of system 100. As shown in FIG. 3, control ring 104 includes a processor 148 that is in communication with user input mechanisms 144, 146. Upon activation of user input mechanisms 144, 146, processor 148 generates control commands that correspond or relate to the user inputs received by user input mechanisms 144, 146. For example, upon activation of user input mechanism 144, processor 148 may generate a control command that will result in the speed of belt 122, or another movable element of exercise device 102, being increased. Likewise, upon activation of user input mechanism 146, processor 148 may generate a control command that will result in the speed of belt 122, or another movable element of exercise device 102, being decreased.

In addition to user input mechanisms 144, 146 that may be used to control the speed of a movable element of exercise device 102, control ring 104 may optionally include one or more other user input mechanisms for controlling other operating parameters of exercise device 102 (e.g., incline, resistance) or aspects of an exercise session (e.g., duration, distance). In FIG. 3, for example, control ring 104 is illustrated with an optional emergency stop button 150. Upon activation of emergency stop button 150, processor 148 may generate a control command that will result in exercise device 102 stopping the movement of a movable element, such as belt 122. Emergency stop button 150 may be used when an exerciser falls or become overly fatigued.

Processor 148 may communicate the generated control commands to a transmitter 152 that is part of control ring 104. Transmitter 152 may communicate the control commands to exercise device 102 via a wireless connection between control ring 104 and exercise device 102. The wireless connection between control ring 104 and exercise device 102 may be any type of wireless connection, including Bluetooth, infrared (IR), radio frequency (RF), wireless fidelity (Wi-Fi), and the like. Accordingly, transmitter 152 may be a Bluetooth, infrared (IR), radio frequency (RF), wireless fidelity (Wi-Fi), or other type of wireless transmitter.

As shown in FIG. 3, exercise device 102 includes a receiver 154 that may receive the control commands communicated from control ring 104. Similar to transmitter 152, receiver 154 may be a Bluetooth, infrared (IR), radio frequency (RF), wireless fidelity (Wi-Fi), or other type of wireless receiver that is able to wirelessly communicate with transmitter 152.

Upon receipt of the control commands, receiver 154 may optionally communicate the control commands to controller 128 of exercise device 102. Controller 128 may process the received control commands and then generate and communicate new control commands to actuator 126. Alternatively, controller 128 may, with or without processing the received control commands, communicate the received control commands to actuator 126. In other embodiments, receiver 154 may, upon receipt of the control commands, communicate the received control commands directly to actuator 126. Regardless of whether actuator 126 receives the control commands directly from control ring 104 or via controller 128, in response thereto, actuator 126 may adjust the operating parameters of belt 122 or another movable element of exercise device 102.

Figure 4:
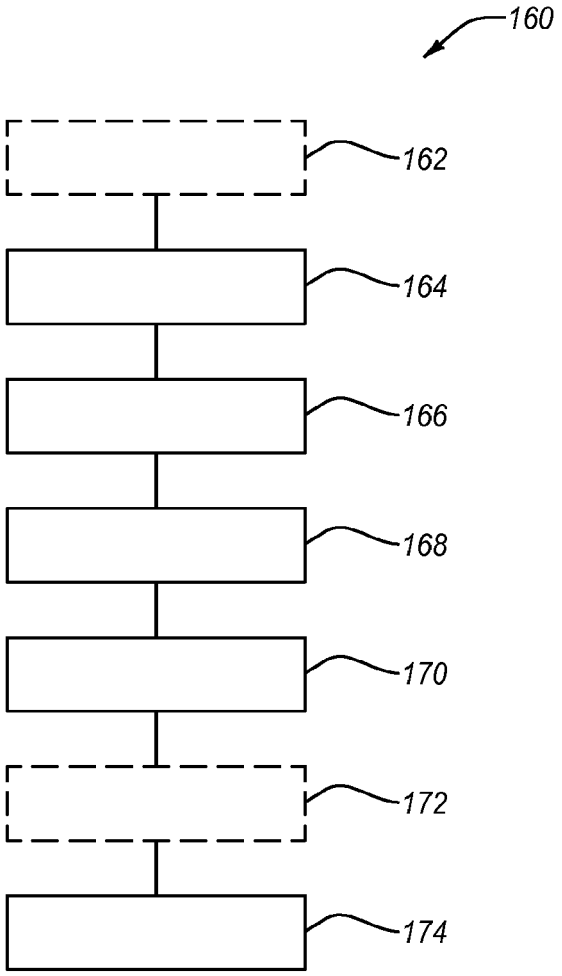
FIG. 4 is a functional block diagram of a process for controlling an exercise device using a control ring.

Attention is now directed to FIG. 4, which illustrates a flow diagram of an exemplary method 160 that may be implemented to adjust one or more operating parameters of exercise device 102. Method 160 may optionally begin with step 162 in which an exercise program is run on an exercise device, such as exercise device 102. The exercise program may include one or more control commands that adjust the operating parameters of the exercise device. For instance, the exercise program may periodically adjust the resistance, incline, or speed of the exercise device and/or the movable elements of the exercise device to vary the intensity of the exerciser's workout or to simulate a real world course. Alternatively, the exercise program may simply be the initial exercise device settings selected by the exerciser. The running of the exercise program may be initiated via one or more of the user input mechanisms 107 on the exercise device.

Method 160 may also include (at step 164) receiving one or more user inputs at a control ring (e.g., 104) worn by an exerciser that is exercising on the exercise device. The user inputs received at the control ring may relate to one or more desired adjustments to be made to the operating parameters of the exercise device. For instance, the user inputs may relate to a desired increase or decrease in the speed, resistance, or incline of the exercise device.

In step 166, control commands may be generated in response to the user inputs received at the control ring. The control command may be representative of the user input received at the control ring, and thus representative of the desired adjustments to be made to the operating parameters of the exercise device.

After generation, the control commands are communicated from the control ring to the exercise device, as indicated in step 168. As noted elsewhere herein, the control commands may be communicated from the control ring to the exercise device via a wireless connection therebetween. In step 170, the control commands are received by the exercise device.

After the exercise device has received the control commands, the exercise device may optionally process the control commands in step 172. Finally, the one or more actuators of the exercise device may adjust the operating parameters of the exercise device in response to the user inputs received at the control ring and in order to reflect the desired changes in the operating parameters.

Figure 5:
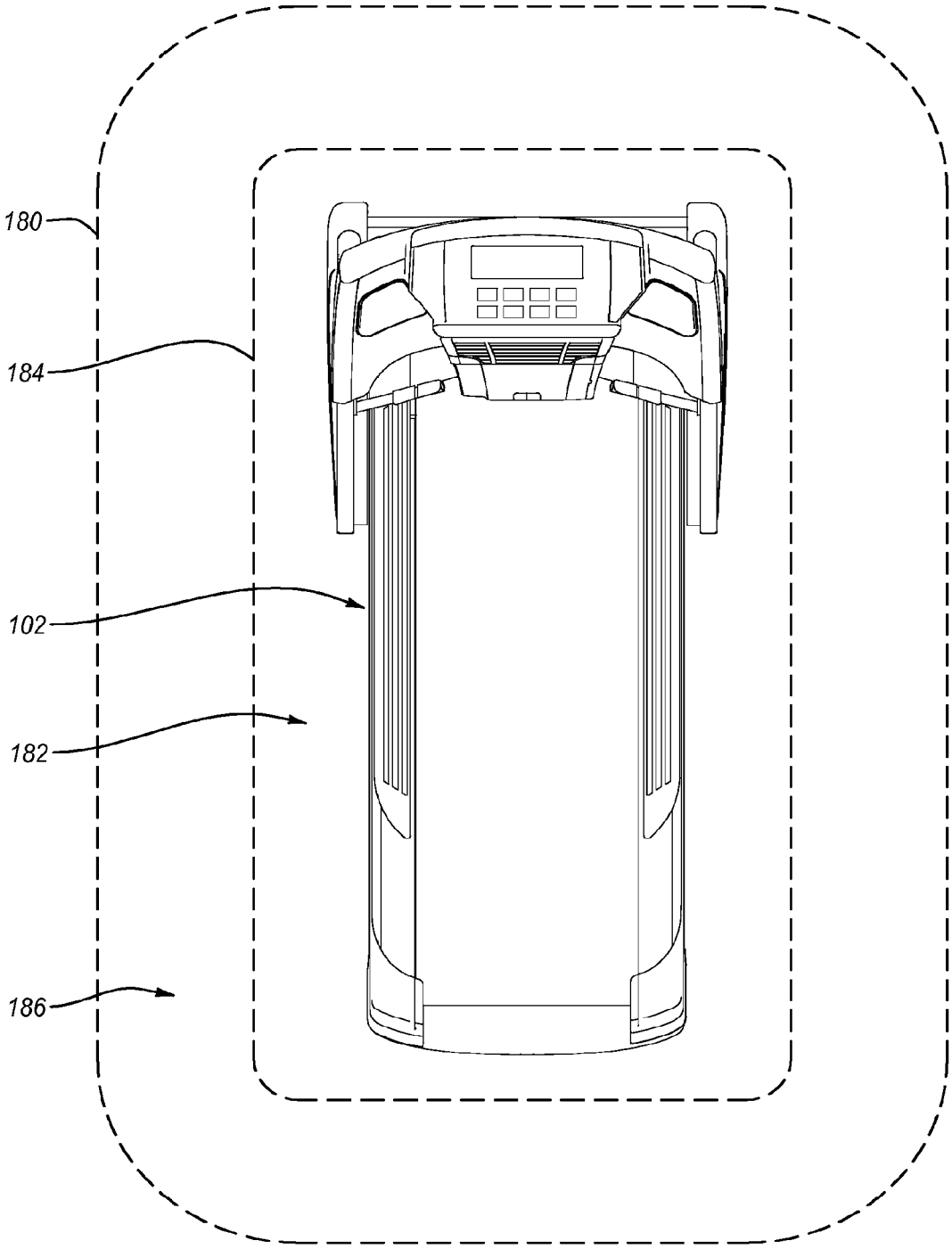
FIG. 5 illustrates different spatial zones which affect the functionality of the exercise system of FIG. 1.

Attention IS now directed to FIG. 5. Exercise system 100 may include one or more control or safety features. For instance, exercise device 102 and control ring 104 may be paired with one another in such a manner that exercise device 102 only responds to control commands received from control ring 104 and not from other control rings.

The pairing between exercise device 102 and control ring 104 may be accomplished in a variety of ways. For instance, exercise device 102 may be designed to respond to control commands from only control ring 104. Similarly, control ring 104 may be designed to communicate with only exercise device 102. This dedicated pairing between exercise device 102 and control ring 104 may be accomplished by encrypting the control commands from control ring 104.

Alternatively, exercise device 102 and control ring 104 may be selectively paired with one another. For instance, a virtual handshake may be created between exercise device 102 and control ring 104. When exercise device 102 and control ring 104 are selectively paired via a virtual handshake, exercise device 102 may be designed to ignore or otherwise not respond to control commands from other control rings. When exercise device 102 and control ring 104 are not paired with one another, exercise device 102 may be paired with and respond to control commands from another control ring. Similarly, when exercise device 102 and control ring 104 are not paired with one another, control ring 104 may be paired with and communicate control commands to another exercise device.

In still other embodiments, the pairing between exercise device 102 and control ring 104 may be created based on their proximity to one another. For instance, transmitter 152 of control ring 104 may have a limited communication range. Likewise, exercise device 102 may be designed to communicate only with other devices that are within a predetermined range. As a result, control ring 104 may communicate with exercise device 102 and exercise device 102 may respond to control ring 104 when control ring 104 is within a predetermined range of exercise device 102.

As shown in FIG. 5, an example of predetermined range is shown encompassed by dashed line 180. When control ring 104 is within predetermined range 180, exercise device 102 and control ring 104 may be paired with one another. In contrast, when control ring 104 is not within predetermined range 180, exercise device 102 and control ring 104 may not be paired with one another. Accordingly, exercise device 102 may be paired with and respond to control commands from only one control ring at any given time. Likewise, control ring 104 may optionally be paired with only one exercise device at a time.

Predetermined range 180, as shown in FIG. 5, optionally includes two zones. The first zone 182 includes the area encompassed by dashed line 184 and the second zone 186 is the area between dashed lines 180, 184. Exercise device 102 and/or control ring 104 may be designed so that control ring 104 is fully functional when control ring is within first zone 182. In other words, when control ring 104 is within first zone 182, control ring 104 may communicate any type of control command to exercise device 102 and exercise device 102 may be responsive thereto. For instance, when control ring 104 is within first zone 182, control ring 104 may communicate control commands relating user selected adjustments to be made to the operating parameters of exercise device 102. Additionally, exercise device 102 may respond to the received control commands by adjusting the operating parameters when control ring 104 is within first zone 182.

In contrast, control ring 104 may have limited functionality when control ring 104 is within second zone 186. In other words, when control ring 104 is within second zone 186, control ring 104 may communicate only certain types of control commands to exercise device 102 and/or exercise device 102 may respond to only certain types of control commands. For instance, when control ring 104 is within second zone 186, control ring 104 may communicate an emergency stop control command to exercise device 102 and/or exercise device 102 may only respond to an emergency stop control command from control ring 104. Exercise device 102 may respond to the received emergency stop control command by stopping the movement of one or more movable elements of exercise device 102. When control ring 104 is within second zone 186, control ring 104 may not generate and/or communicate and/or exercise device 102 may not respond to other types of control commands, such as speed increase control commands.

When control ring 104 is within second zone 186, the emergency stop control command may be generated in at least one of multiple ways. For example, as discussed above, emergency stop button 150 may be activated in order to generate an emergency stop control command. Alternatively, if control ring 104 moves from first zone 182 to second zone 186, control ring 104 may automatically generate an emergency stop control command. Upon generation of an emergency stop control command, control ring 104 may communicate the emergency stop control command to exercise device 102 in order to stop the movement of one or more of the movable elements of exercise device 102. In still other embodiments, if exercise device 102 detects that control ring 104 moves from first zone 182 to second zone 186, exercise device 102 may generate an emergency stop control command to stop the movement of one or more of the movable elements of exercise device 102.

Various technologies may be used to determine when control ring 104 is within predetermined range 180, first zone 182, or second zone 186. For instance, one or more sensors may be positioned on exercise device 102 which are capable of detecting the presence of control ring 104 within predetermined range 180, first zone 182, or second zone 186. Such sensor may include, but are not limited to infrared sensors, metal detectors, proximity sensors, sonar sensors, radar sensors, Doppler sensors, or combination thereof.

Figure 6:
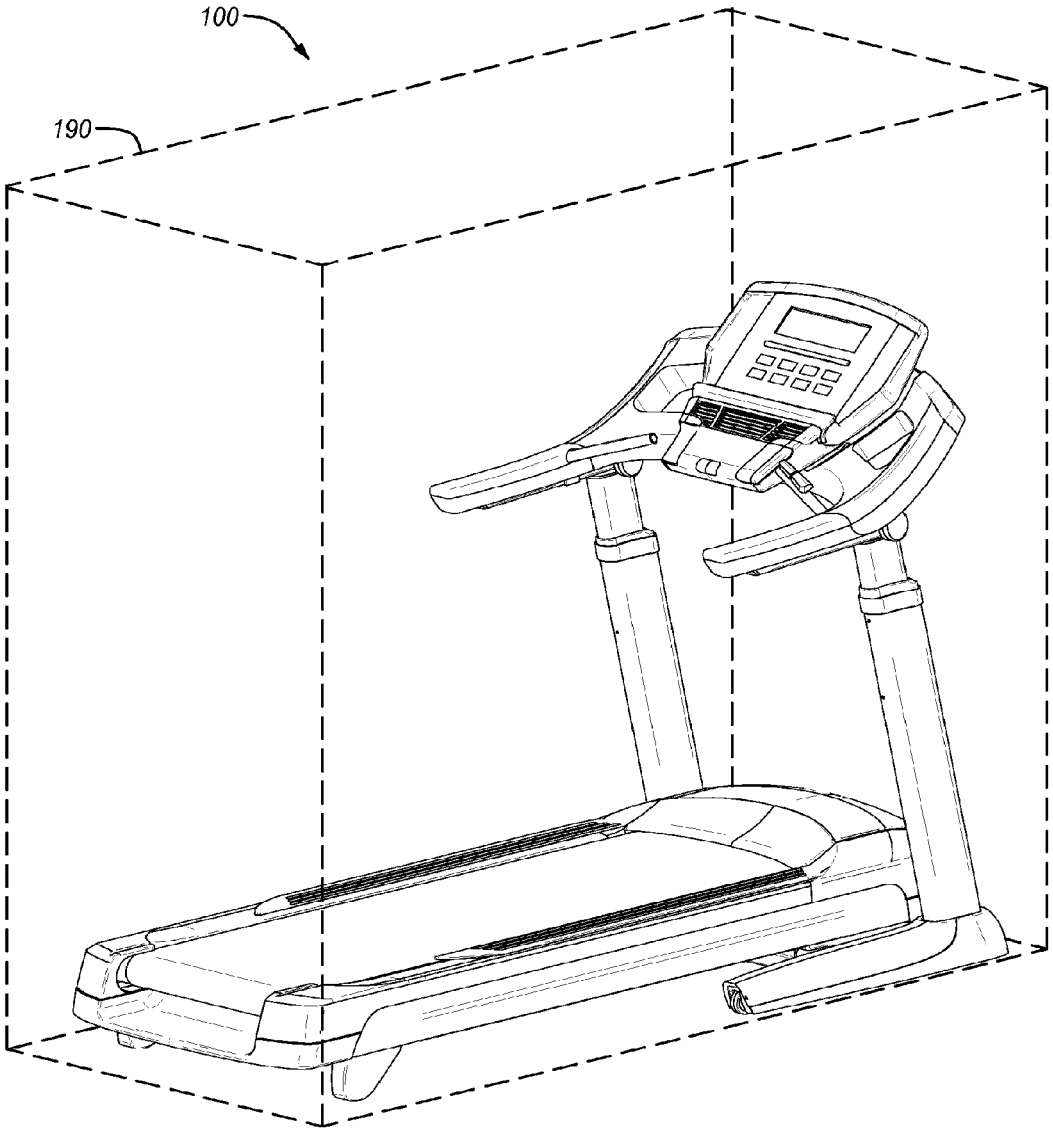
FIG. 6 illustrates a spatial zone which affects the functionality of the exercise system of FIG. 1.

Attention is now directed to FIG. 6, which illustrates another example of a predetermined range 190 shown encompassed by dashed lines. Predetermined range 190 is illustrated as a generally rectangular cube shaped area around exercise device 102. When control ring 104 is within predetermined range 190, exercise device 102 and control ring 104 may be paired with one another. In contrast, when control ring 104 is not within predetermined range 190, exercise device 102 and control ring 104 may not be paired with one another.

Similar to the embodiment shown in FIG. 5, when control ring 104 is within predetermined range 190, control ring 104 may communicate control commands to exercise device 102 and exercise device 102 may be responsive thereto. For instance, when control ring 104 is within predetermined range 190 (such as when worn by an exerciser on exercise device 102), control ring 104 may communication control command (e.g., increase/decrease speed) to exercise device 102. Exercise device 102 may respond to the control command by adjusting the appropriate operating parameters of exercise device 102. If control ring 104 is outside predetermined range 190, however, control ring 104 may not be able to communicate control commands to exercise device 102 or exercise device 102 may not respond to control commands from control ring 104.

If control ring 104 moves from inside to outside of predetermined range 190 while exercise device 102 is operating, control ring 104 and/or exercise device 102 stop certain operations of exercise device 102. For instance, if an exerciser intentionally or unintentionally gets off of exercise device 102 while exercise device 102 is still operating (e.g., movable element(s) are still moving), control ring 104 may communicate an emergency stop control command to exercise device 102 and/or exercise device 102 may respond to only an emergency stop control command from control ring 104. The emergency stop control command may be automatically generated by control ring 104 when control ring 104 leaves predetermined range 190. Alternatively, the emergency stop control command may be generated by the exerciser activating emergency stop button 150. In yet other embodiments, if exercise device 102 detects that control ring 104 moves from inside to outside predetermined range 190, exercise device 102 may generate an emergency stop control command. In any case, exercise device 102 may respond to the received emergency stop control command by stopping the movement of one or more movable elements of exercise device 102. When control ring 104 outside of predetermined range 190, control ring 104 may not generate and/or communicate and/or exercise device 102 may not respond to other types of control commands, such as speed increase control commands.

Like the embodiment of FIG. 6, it may be determined that control ring 104 is inside or outside predetermined range 190 using such technologies as infrared sensors, metal detectors, proximity sensors, sonar sensors, radar sensors, Doppler sensors, or combination thereof.

Figure 7:
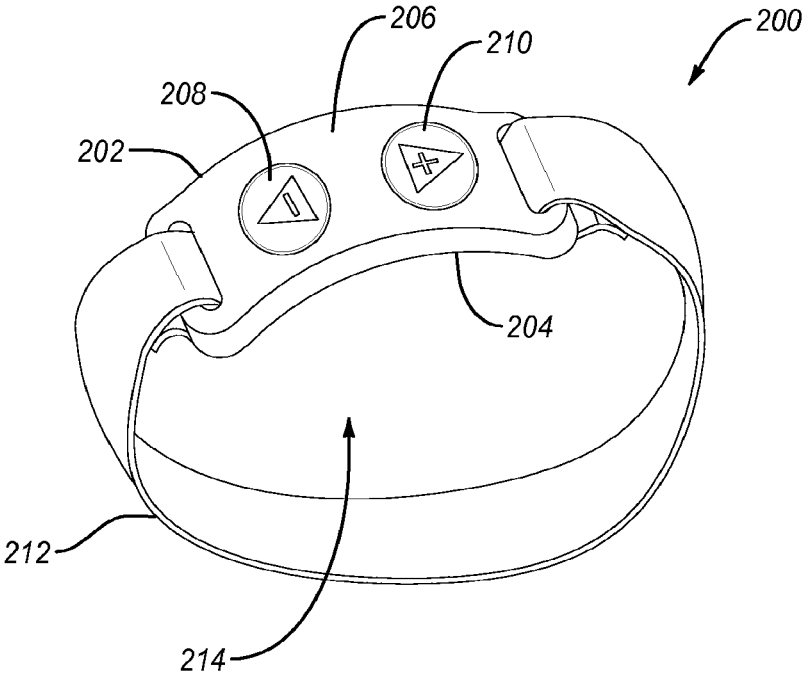
FIG. 7 illustrates an exercise control ring according to one example embodiment.
Figure 8:
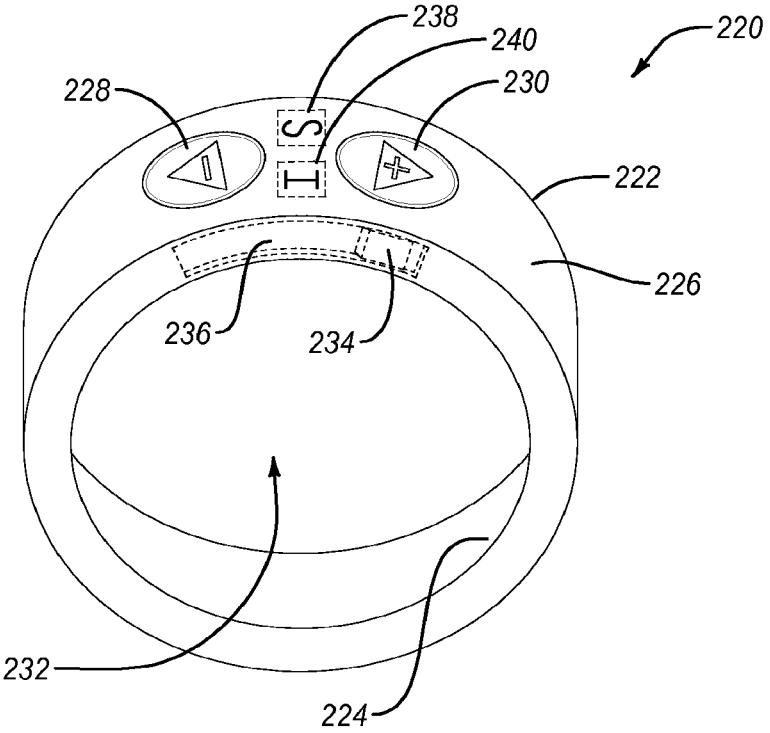
FIG. 8 illustrate an exercise control ring according to another example embodiment.

FIGS. 7 and 8 illustrate alternate embodiments of control rings for use in controlling exercise devices. FIG. 7 illustrates a control ring 200 that includes a body 202. Body 202 has an interior surface 204 and an exterior surface 206. Interior surface 204, and optionally all of body 205, is generally arcuate in shape. Interior surface 204 may be sized and shaped such that control ring 200 can be worn on a finger of an exerciser, as shown in FIG. 2. That is, interior surface 204 may be curved or otherwise shaped to generally correspond to the shape of an exerciser's finger.

Like control ring 104, control ring 200 includes user input mechanisms 208,210. In the illustrated embodiment, user input mechanisms 144, 146 are disposed on or extend from exterior surface 206 of body 202. Like user input mechanisms 144, 146, user input mechanisms 208, 210 may be selectively activated by an exerciser in order to adjust the operating parameters of an exercise device. For instance, user input mechanism 208 may be a speed decrease button and user input mechanism 210 may be a speed increase button. Upon activation of user input mechanism 208, control ring 200 may communicate a control command to an exercise device that results in a decrease in the speed of one or more of the movable elements of the exercise device. Similarly, upon activation of user input mechanism 210, control ring 200 may communicate a control command to an exercise device that results in an increase in the speed of one or more of the movable elements of the exercise device.

Control ring 200 also includes strap 212 that may be used to selectively secure body 202 on an exerciser's finger. Strap 212 is connected to opposing ends of body 202 so that body 202 and strap 212 define an aperture 214 through control ring 200. Aperture 214 may be sized such that control ring 104 can be worn on a finger of an exerciser, as shown in FIG. 2. That is, aperture 214 may have a diameter that generally corresponds to a diameter of an exerciser's finger. Optionally, strap 212 may be made from a stretchable material (e.g., spandex, nylon, foam, rubber, fabric) so that the size of aperture 214 may be adjusted to accommodate fingers of different sizes.

FIG. 8 illustrates a control ring 220 that includes a body 222 that has a generally circular ring shape. More specifically, body 222 includes an interior surface 224 and an exterior surface 226. Interior surface 224 at least partially defines an aperture 232 in body 222. Aperture 232 may be sized such that control ring 220 can be worn on a finger of an exerciser, as shown in FIG. 2. That is, aperture 232 may have a diameter that generally corresponds to a diameter of an exerciser's finger.

Similar to the other control rings described herein, control ring 220 includes user input mechanisms 228, 230 that may be activated by an exerciser to adjust the operating parameters of an exercise device. In addition, control ring 220 optionally includes a selector 234 that may be selectively moved between one or more positions. Selector 234 may be used to change the functionality of user input mechanisms 228, 230. For instance, when selector 234 is in the position shown in FIG. 8, user input mechanisms 228, 230 may be used to change the speed of a movable element on an exercise device. In contrast, when selector 234 is moved to another position within channel 236, user input mechanisms 228, 230 may be used to change the incline of a movable element on an exercise device.

Control ring 220 can also optionally include one or more indicators, such as indicators 238, 240. Indicators 238, 240 may indicate to the exerciser what operating parameters control ring 220 is set to control. That is, when selector 234 is set so that user input mechanisms 228, 230 control the speed of a movable element of an exercise device, indicator 238 may be activated so that the exerciser will know that activation of user input mechanisms 228, 230 will change the speed of the movable element. Likewise, when selector 234 is set so that user input mechanisms 228, 230 control the incline of a movable element of an exercise device, indicator 240 may be activated so that the exerciser will know that activation of user input mechanisms 228, 230 will change the incline of the movable element.

INDUSTRIAL APPLICABILITY

In general, embodiments of the present disclosure relate to exercise systems, devices, and methods that enable an exerciser to control operating parameters of an exercise device without having to manipulate controls on the exercise device itself. The systems, devices, and methods of the present disclosure allow an exerciser to adjust the operating parameters of an exercise device using a control ring that is worn on the exerciser's hand.

When exercising on an exercise device, an exerciser may desire to adjust one or more operating parameters of the exercise device in order to change one or more aspects of the exercise being performed. For instance, the exerciser may want to increase or decrease the speed of the exercise device's movable element(s) in order to change the speed at which the exercise is performed. In other situations, the exerciser may want to increase or decrease the resistance provided by the exercise device and/or the incline at which the exercise is performed.

The systems and devices disclosed herein enable an exerciser to adjust the operating parameters of an exercise device using a control ring that the exerciser wears. The control ring includes user input mechanisms that the exerciser can activate to adjust the operating parameters of the exercise device. Significantly, adjusting the operating parameters with the control ring reduces or eliminates the need for the exerciser to manipulate controls on the console of the exercise device.

Manipulating controls on the console of an exercise device can be difficult, especially during the performance of an exercise. For instance, when an exerciser is running on a treadmill, it can be difficult to reach the treadmill console and press the desired buttons in order to achieve the desired operating parameter adjustments. Furthermore, manipulating console controls can also negatively impact the exercisers exercising form and/or performance. For instance, reaching for the console controls may cause the exerciser to undesirably change his/her pace, stride length, speed, and/or loose his/her balance.

In contrast to manipulating controls on an exercise device console, a control ring worn by an exerciser enables the exerciser to more easily adjust the operating parameters of the exercise device without negatively impacting the exerciser's form and/or performance. The exerciser can simply activate one of the user input mechanisms on the control ring in order to achieve the desired operating parameter change. For instance, rather than having to interrupt the exerciser's form in order to reach forward to manipulate a console control, the exerciser can simply use a finger on the same hand that wears the control ring to press a button on the control ring.

While the control ring provides an easier and simpler way of adjusting the operating parameters of an exercise device, the control ring does not negatively impact the exerciser's performance. For instance, since the control ring is worn on a finger, the exerciser does not have to constantly hold or carry the control ring with his/her hand. Rather, when not using the control ring to adjust the operating parameters, the exerciser can relax his/her hand and without worrying about dropping the control ring. Furthermore, the control ring is lightweight enough as to not be bothersome or burdensome to the exerciser.

The disclosed devices/systems also provide various safety features. For instance, the control ring and/or the exercise device may be paired with one another so that control commands from only one control ring cause adjustments to be made to the operating parameters of the exercise device. The pairing of the exercise device and the control ring may prevent a second control ring from causing adjustments to be made to the exercise device without the exerciser's knowledge or approval.

Another safety feature of the disclosed devices/system is the emergency stop feature. An emergency stop control command may cause the exercise device to stop the movement of a movable element. An emergency stop control command may be generated as a result of an exerciser activating a button on the control ring. For instance, when the exerciser feels overly fatigued, loses his/her balance, or falls, the exerciser can press an emergency stop button on the control ring to cause the exercise device to stop the movable element. Alternatively, the emergency stop control command may be automatically generated upon a predetermined occurrence. For instance, if an exerciser falls off or leaves the exercise device, an emergency stop control command may be generated, either by the control ring or the exercise device, in order to stop a movable element of the exercise device.

A control ring may be a closed loop. For instance, the body of a control ring may form a closed loop that defines an aperture extending through the ring. In other embodiments, the body and a fastener may cooperate to form a closed loop. In other embodiments, however, a control ring may not be a closed loop. Rather, a control ring may include an opening or a space between opposing ends to allow an exerciser's finger to pass therethrough in order to put the ring on the exerciser's finger.

A control ring may include user input mechanisms that only adjust one operating parameter of an exercise device. For instance, the user input mechanisms may only adjust the speed of a movable element. Alternatively, a control ring may include multiple user input mechanisms that adjust multiple operating parameters of an exercise device. Alternatively still, a control ring may include a single set of user input controls that adjust the operating parameters of an exercise device. In this case, the control ring may include a selector that determines which operating parameters will be adjusted upon activation of the user input controls. When the selector is in one position, activation of the user input controls may adjust one operating parameter. When the selector is in another position, activation of the user input controls may adjust a different operating parameter.

While embodiments of the invention have been described in the context of a motorized treadmill, it is understood that the invention is not limited to any particular type of exercise device. Accordingly, the term "exercise device" shall refer broadly to any type of device that takes the form of an exercise machine, including, but not limited to, treadmills, exercise cycles, Nordic style ski exercise devices, rowers, steppers, hikers, climbers, and elliptical or striding exercise devices. These various types of exercise devices may include adjustable operating parameters similar to those described above (e.g., speed, incline, etc.). Additionally, these exercise devices may also have adjustable operating parameters such as resistance to the movement of a movable element (e.g., belt, pedal, link arm, etc.). Accordingly, a control ring may be used to adjust the operating parameters of various types of exercise devices so an exerciser does not have to manipulate controls located on the exercise device itself.

What is claimed is:

1. A remote control usable in adjusting one or more operating parameters of an exercise device, the remote control comprising:

a body; and a transmitter associated with the body;

wherein the transmitter communicates with the exercise device only when the remote control is within a predefined range of the exercise device;

wherein the predefined range includes a first zone, wherein the transmitter communicates control commands that control movement of a movable element of the exercise device to the exercise device upon activation of one or more user input mechanisms associated with the body when the remote control is within the first zone, and a second zone, wherein the transmitter communicates only an emergency stop control command to stop movement of the movable element of the exercise device upon activation of another of the one or more user input mechanisms when the remote control is within the second zone.

2. The remote control of claim 1, wherein the remote control further comprises a control ring including said body having an interior surface and an exterior surface and which is wearable on a finger of a user.

3. The remote control of claim 2, wherein the control ring comprises one or more straps connected to the body, wherein the one or more straps selectively secure the body on the finger of the user.

4. The remote control of claim 3, wherein the one or more straps comprise a first strap connected to a first end of the body and a second strap connected to a second end of the body, wherein the first strap and the second strap are configured to be selectively connected to one another to selectively secure the body on the finger of the user.

5. The remote control of claim 4, wherein the first strap and the second strap are the configured to be selectively connected to one another with at least one of a hook and loop fastener, a clip, and a buckle.

6. The remote control of claim 3, wherein the one or more straps comprise a strap connected between a first end and a second end of the body, such that the strap and the body cooperate to define an aperture through the remote control.

7. The remote control of claim 2, wherein the interior surface is generally arcuately shaped to generally correspond to a shape of the user's finger, and wherein the one or more user input mechanisms are disposed on the exterior surface of the body.

8. The remote control of claim 1, wherein the predefined range is determined by at least one sensor positioned on the exercise device.

9. The remote control of claim 8, wherein the at least one sensor comprises at least one of an infrared sensor, a metal detector, a proximity sensor, a sonar sensor, a radar sensor, or a Doppler sensor.

10. The remote control of claim 1, wherein the predefined range is determined by a wireless connection.

11. The remote control of claim 1, wherein the one or more user input mechanisms comprise a speed increase button and a speed decrease button, wherein:

upon activation of the speed increase button, the transmitter communicates a control command to the exercise device to increase the speed of the movable element of the exercise device, and upon activation of the speed decrease button, the transmitter communicates a control command to the exercise device to decrease the speed of the movable element of the exercise device.

12. The remote control of claim 1, wherein the remote control is configured to be selectively paired with only one exercise device at any given time.

13. The remote control of claim 1, further comprising a processor associated with the one or more user input mechanisms and the transmitter, wherein the processor generates the control command upon activation of the one or more user input mechanisms.

14. The remote control of claim 1, wherein the another of the one or more user input mechanisms comprise an emergency stop button.

15. An exercise system, comprising:

an exercise device comprising:

a movable element that is movable during the performance of exercise, the movable element having one or more adjustable operating parameters;

a receiver that receives control commands related to the one or more adjustable operating parameters; and an actuator that adjusts the one or more adjustable operating parameters in response to the control commands received by the receiver; and a remote control, the remote control comprising:

one or more user input mechanisms selectively activatable by a user; and a transmitter associated with the one or more user input mechanisms, wherein the transmitter communicates control commands to the exercise device;

wherein the transmitter communicates with the exercise device only when the remote control is within a predefined range of the exercise device; and wherein the predefined range includes a first zone, wherein the transmitter communicates control commands to the exercise device upon activation of the one or more user input mechanisms to adjust the one or more adjustable operating parameters of the movable element when the remote control is within the first zone, and a second zone, wherein the transmitter communicates only an emergency stop control command to stop the movement of the movable element of the exercise device upon activation of another one of the one or more user input mechanisms when the remote control is within the second zone.

16. The exercise system of claim 15, wherein the transmitter of the remote control is a wireless transmitter.

17. The exercise system of claim 15, wherein the predefined range is determined by at least one sensor positioned on the exercise device.

18. The exercise system of claim 15, wherein the one or more adjustable operating parameters comprise a speed of the movable element.

* * * * *